US006348848B1

(12) United States Patent
Herbert

(10) Patent No.: US 6,348,848 B1
(45) Date of Patent: Feb. 19, 2002

(54) TRANSFORMER HAVING FRACTIONAL TURN WINDINGS

(76) Inventor: Edward Herbert, 1 Dyer Cemetery Rd., Canton, CT (US) 06019

( * ) Notice: Subject to any disclaimer, the term of this patent is extended or adjusted under 35 U.S.C. 154(b) by 0 days.

(21) Appl. No.: 09/848,671

(22) Filed: May 3, 2001

Related U.S. Application Data

(60) Provisional application No. 60/201,999, filed on May 4, 2000.

(51) Int. Cl.[7] ..... H01F 17/06

(52) U.S. Cl. ..... 336/178; 336/212; 323/308

(58) Field of Search ..... 323/362, 331–334, 323/308, 249; 335/209–306; 363/45, 91, 126; 336/178, 212

(56) References Cited

U.S. PATENT DOCUMENTS 4,766,365 A * 8/1988 Bolduc et al. ..... 323/308

5,335,163 A * 8/1994 Seiersen ..... 363/126

* cited by examiner

*Primary Examiner*—Lincoln Donovan
*Assistant Examiner*—Tayler Nguyen

(57) ABSTRACT

In a transformer wound on a core having three or more legs (N legs), N–1 of the legs can have a flux distribution winding on them comprising flux distribution coils on each of the N–1 legs. The flux distribution coils are all connected together, usually in phase, so all of the coils see the same voltage. If the several coils have different numbers of turns, then the volt per turn will differ inversely, and so too will the flux in the N–1 legs. The flux in the Nth leg is the algebraic sum of the flux in the N–1 legs, and is usually the "Main" flux path. A winding around one of the legs would have a terminal voltage proportional to the number of turns and the flux in the leg. A winding may make several turns around the main leg of the transformer, then make one or more turns around a side leg having a different flux, usually some fraction of the flux in the main leg. The extra turns, having a fractional flux, are the equivalent of a fractional turn. The ampere-turns are reconciled by a circulating current in the flux distribution windings.

17 Claims, 8 Drawing Sheets

TRANSFORMER HAVING FRACTIONAL TURN WINDINGS

BACKGROUND OF THE INVENTION

This application is a continuation-in-part of a provisional patent application of the same name, Ser. No. 60/201,999 filed May 4, 2000. Priority to that date is claimed.

This invention relates to transformers, especially to transformers in which it is desired to have particular ratios of input voltage to one or more output voltages. This ratio is usually determined by the relative number of turns, or "turns ratio" of the various windings of the transformer, but in prior art transformers this is restricted to whole number ratios.

As the operating frequency of transformers increases, and the operating voltage decreases, single turn windings, or windings having only a few turns, are becoming more and more common. With a large number of turns, it is fairly easy to get an arbitrary ratio of the input to the outputs, such as 127 to 13 to 7.

With a single turn secondary, there are large gaps between the available ratios using whole numbered turns. As an example, there is a big difference between a 4 to 1 and a 3 to 1 turns ratio, but nothing in between is commonly available. There is some prior art teaching half turn windings. U.S. Pat. No. 5,999,078, Herbert, teaches a transformer module with a "half turn" secondary. U.S. Pat. No. 3,768,055, Oliver, also teaches a "half turn" secondary winding. U.S. Pat. No. 6,137,392, Herbert, has embodiments having a "half turn" secondary winding.

OBJECT OF THE INVENTION

It is an object of the present invention to be able to use intermediate fractional turns, for example 6.3 to 3.7 to 1. A flux distribution winding can be added to two or more parallel legs of a transformer to apportion the flux among them. A winding on a particular leg with a portion of the total flux will have an equivalent winding which is a fraction proportional to portion of the flux.

BRIEF DESCRIPTION OF THE FIGURES

FIG. 13 shows exaggerated spacing, to more clearly show the flux distribution windings.

FIG. 14 shows the cores closer together, and also shows the other windings of the transformer.

DESCRIPTION OF THE PREFERRED EMBODIMENT OF THE INVENTION

Figure 1:
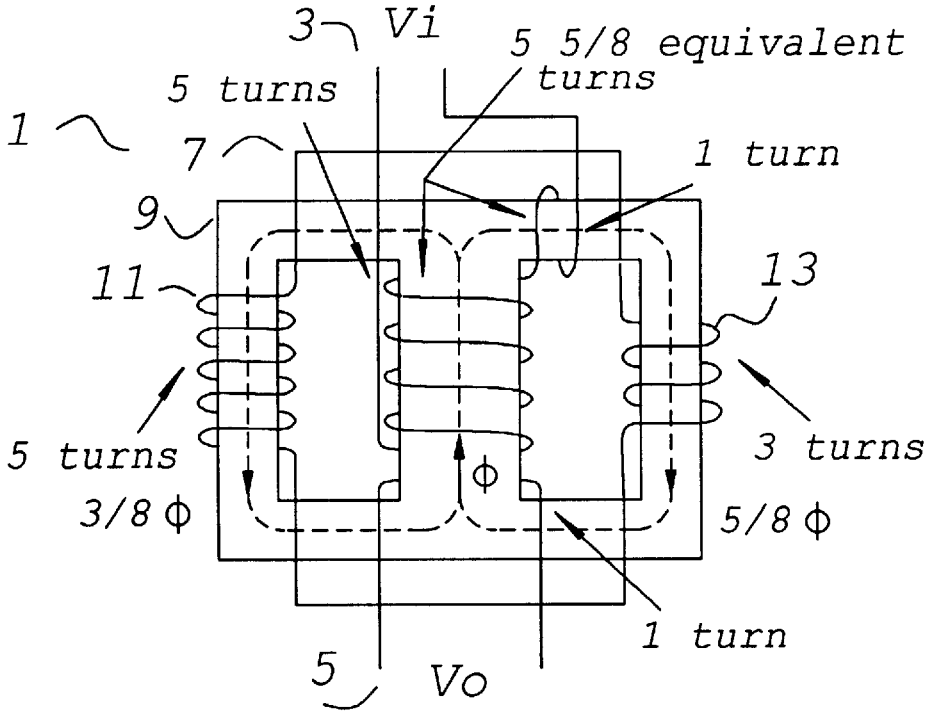
FIG. 1 shows a transformer of this invention having a ratio of 5⅝ to 1.

FIG. 1 shows a simple transformer 1 of the present invention having a primary winding 3 having an equivalent turns of 5⅝. The secondary winding 5 has a single turn. Both windings 3 and 5 are shown as single windings having a start and an end, as an illustration, not a limitation, as they may be any winding configuration such as split, bi-filar, push-pull and so forth. One skilled in the art of transformers would readily understand how to substitute such alternative windings, and it is not a point of novelty, so single windings are shown throughout to simplify the drawings and the discussion.

It can be seen that there is an additional flux distributing winding 7 comprising two windings 11 and 13 on the outer legs of a transformer core 9, shown as an illustration, not a limitation, as an E-E core. A first winding 11 of the flux distributing winding 7 has 5 turns as indicated, and a second winding 13 has 3 turns. They are connected together so as to force the voltage to be the same on both windings 11 and 13. A winding (or coil) necessarily has a first terminal and a second terminal at the ends of the wire of which it is wound. In the specification and in the claims, when windings or coils are said to be "connected" together, it means that one terminal of one winding is connected to one or the other terminal of the second winding, then the remaining terminals of the two windings are connected to each other. In addition, a winding may have terminal which is a tap, but unless a tap is specified, it is the ends of the winding that are connected. In the jargon of the art, these are sometimes referred to as the start and end of the winding.

It is will understood in the art of transformer design that the "flux" is uniquely determined by the integral of the voltage in each turn of a winding with respect to time. For a rectangular wave form, common in switched mode power supplies, the flux relates to the applied voltage multiplied by time and divided by the number of turns, as would be well understood by one familiar with the art of switch mode power supplies and the like.

More precisely, the voltage appearing on any turn in any winding is determined by the rate of change of the magnetic flux within the winding, and the rate of change of magnetic flux is determined by the voltage on the winding. If there are multiple turns on the winding, the total voltage is the voltage per turn times the number of turns.

In this specification and the claims, "flux" is used as a short hand notation for "the rate of change of magnetic flux". If a winding is said to have half the flux of another, it means that the rate of change of magnetic flux is one half that of the rate of change of magnetic flux in the other. In this notation, if a winding is said to have half the flux of another, it will have half the voltage of the other.

To operate a transformer, there must be a source of magnetomotive force. Usually this is current flowing through one or more winding as the result of an applied voltage Vi. The magnetomotive force will have a phase determined by the timing and direction, and the phase of the other windings of the transformer are referenced to this by appropriate winding direction and connection, as would be well understood by one skilled in the art of transformers.

A magnetomotive force may be applied to one leg of a transformer core. If there are multiple return paths, the return flux will distribute among them. Without other constraint, the relative reluctance of the paths may determine the flux distribution. This invention teaches how to control the flux distribution and use it to advantage.

The magnetomotive force may be applied to two or more legs of the transformer coe, and forcing a flux distribution as taught herein may force the sum or the difference in another leg of the transformer core. Defining the flux distribution in N−1 legs of a transformer core having N parallel legs necessarily determines the flux in the remaining leg as the algebraic sum of the defined fluxes.

The two windings 11 and 13 of the flux distributing winding 7 have the same terminal voltage because they are tied together, but they have a different number of turns. Therefore the voltage per turn must be different. The voltage may be calculated by analysis, but the important pint is that the relationship of the fluxes in the two legs to each other and to the center let is uniquely determined. The flux will be determined by the volts per turn in each winding, so the ratio of the fluxes as a proportion of the total flux is the ratio of the inverse of the turns in each winding 11 and 13 of the flux distribution winding 7.

Figure 2:
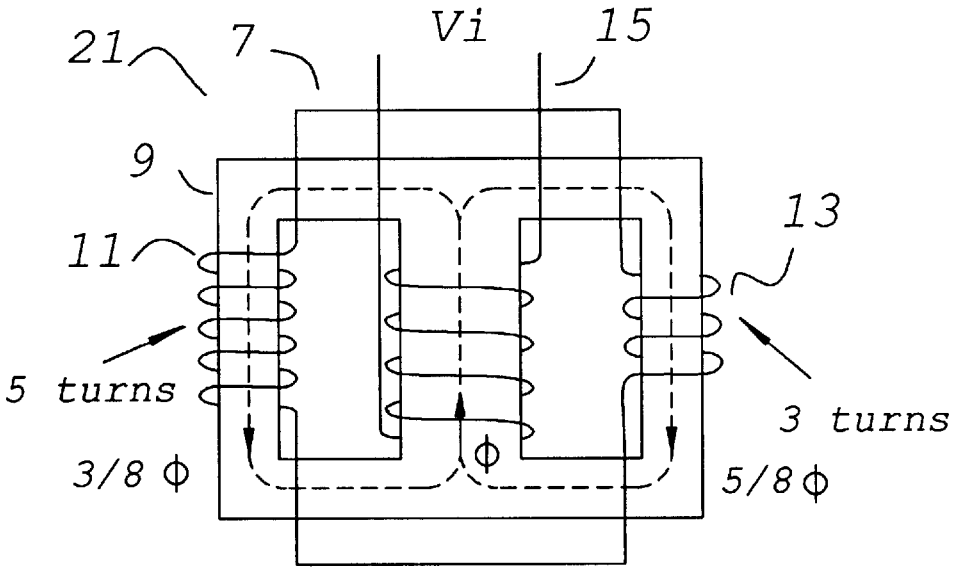
FIG. 2 shows a transformer similar to the transformer of FIG. 1 with fewer, simpler windings to more clearly show the flux distribution winding.

To better illustrate this concept, please refer to the transformer 21 of FIG. 2. (Several parts of he transformer 21 of FIG. 2 are the same as those I the transformer 1 of FIG. 1, and they have the same reference designators.) An input winding 15 has 5 turns, and will induce a flux in the center leg of the transformer core 9. The flux divides and returns through the two outside legs of the transformer, as indicated by the dashed lines and arrows. In a prior art transformer, the division of the flux through he outer legs would be approximately equal, and would be determined by the relative reluctance of the two paths which will usually be approximately the same. However, the flux distributing winding 7 forces a division of the flux in proportion to the relative voltage per turn in the side windings 11 and 13. In this example, one side winding 11 has 5 turns, the other side winding 13 has 3 turns. The windings 11 and 13 are connected together in phase, that is, like polarity ends of the windings 11 and 13 are connected together. To further explain, if the windings 11 and 13 are connected together on one end only, the open ends of the windings would both have the same polarity voltage when the input winding is excited. With no other constraints and nominally equal reluctance in the legs of the transformer core 9, the voltages would be different as the number of turns in each. Once connected, the voltage is forced to be the same on the ends of the windings. Given that the number of turns is different, the voltage per turn in each is forced to be different. Accordingly, the flux is forced to divide ⅜ in the path through the side winding 11 and ⅝ in the side winding 13, as shown.

Figure 3:
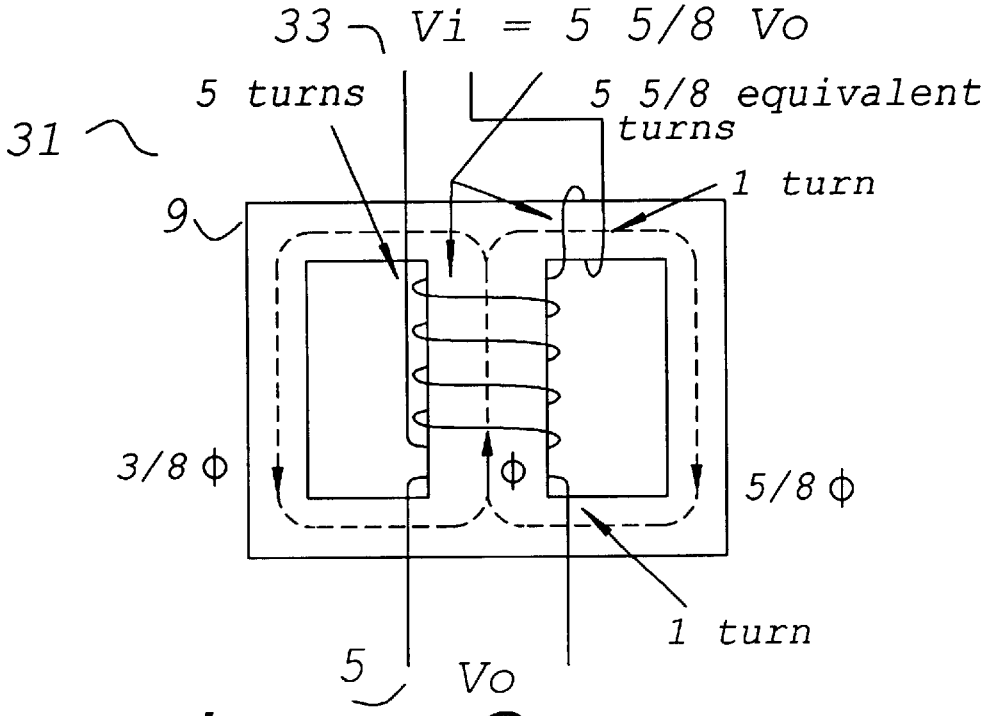
FIG. 3 shows the transformer of FIG. 1 with the flux distribution winding not drawn, but understood to be in place and functional.

Looking now at the transformer 31 of FIG. 3, it can be seen that the primary winding 33 makes 5 turns around the center leg of the transformer core 9 plus an additional one turn around the right hand leg of the transformer core 9. (It is to be understood that the flux distributing winding 7 of FIGS. 1 and 2 is in place to force a flux distribution as indicated, but it is not shown in this FIG. 3 in order to have a less cluttered drawing so as to better illustrate the primary winding 33.) In that the flux distributing winding 7 forces ⅝ of the flux through the right leg of the transformer core 9, a turn around that leg will induce ⅝ of the voltage that a turn around the center leg does. In calculating the voltage ratio of a transformer, usually the same voltage is induced in every turn. However, if a lesser voltage is induced in some particular turn, as in this instance, it can be said to be equivalent to a fractional turn. In the present example, the turn on the right had leg of the transformer core 9 therefore can be said to be equivalent to ⅝ turn, as compared to a "whole" turn on the center leg of the transformer core 9.

FIG. 3 also shows a single turn output winding 5 having a terminal voltage of Vo. Given that the input winding 33 has an equivalent turns of 5⅝, the input voltage Vi will be 5⅝ times the output voltage. The "turns ratio" of a transformer is equal to the ratio of the input voltage to the output voltage, so the "equivalent turns ration" of the transformer 31 is 5⅝ to 1, or 45 to 8. In a prior art transformer, a 45 turn primary winding and an 8 turn secondary winding would have been needed to accomplish this ratio.

Figure 4:
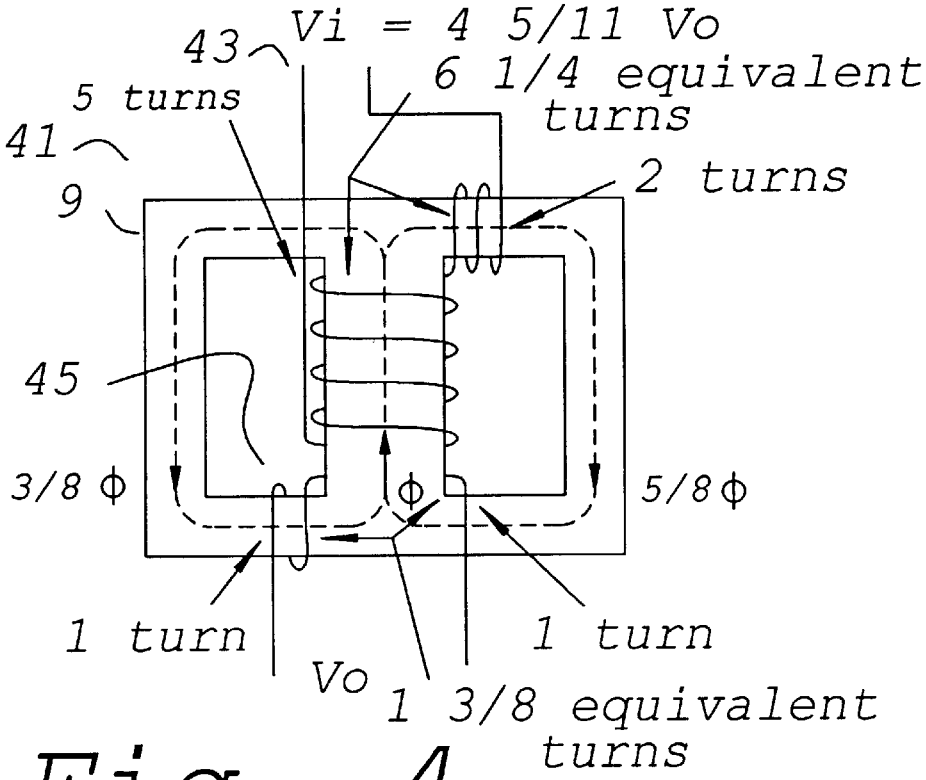
FIG. 4 shows alternative primary and secondary windings.

In the transformer 41 of FIG. 4, both the primary winding 43 and the secondary winding 45 have fractional turns. Again, because the flux is shown to be distributed ⅜ in the left leg and ⅝ in the right leg of the transformer core 9, it is to be understood that the flux distributing winding 7 of FIGS. 1 and 2 is in place, just not shown. Note that the primary winding 41 makes 5 turns around the center leg of the transformer core 9 then two turns around the right leg of the transformer core 9, to give a 6¼ equivalent turns winding. Each turn of the primary winding 43 on the right hand leg of the transformer core 9 is equivalent to ⅝ turn, so two turns is 2 times ⅝, or 1¼ equivalent turns. This is a preferred way to accomplish small fraction additions rather than having more extreme differences in flux, such as would be the case if a flux distributing winding forced a one fourth and three fourths flux distribution.

The secondary winding 45 has one turn around the center leg of the transformer core 9 and continues to make one turn around the left hand leg of the transformer core 9. Because the flux in the left hand leg is constrained by the flux distributing winding 7 (not shown) to be ⅜ of the total flux, the turn around the left leg is equivalent to ⅜ of a turn around the center leg, for a total equivalent turns of 1⅜. Thus the total turns ratio of the transformer 43 is 6¼ to 1⅜, or 50 to 11.

Figure 5:
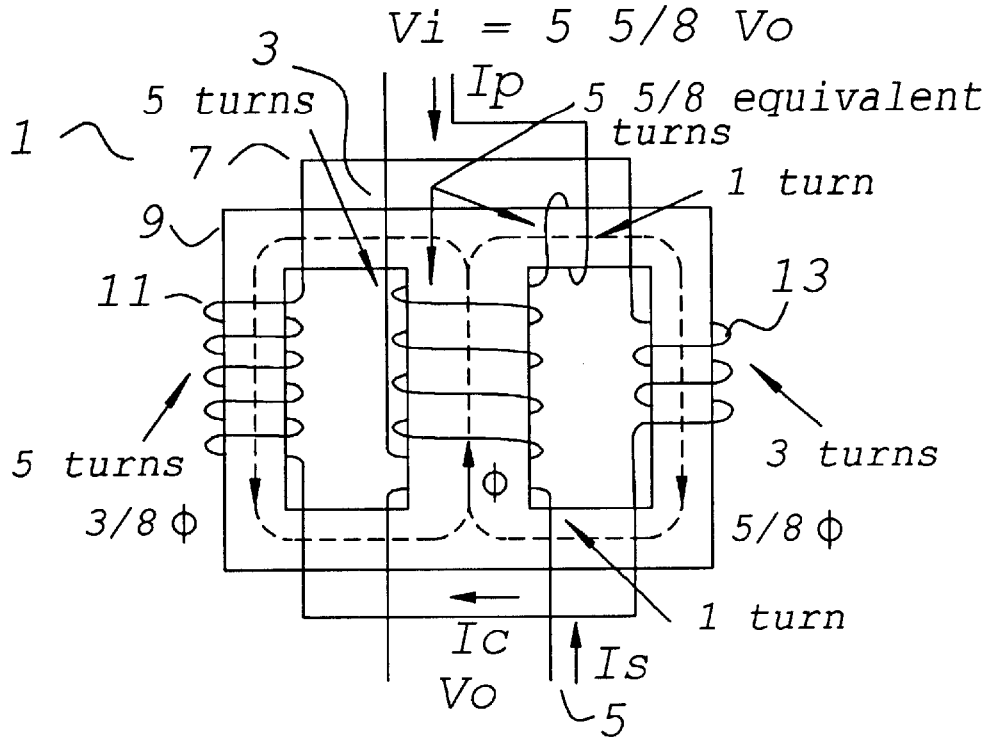
FIG. 5 shows currents in the windings, to support an analysis.

We can now look at the current flow in the transformer 1 of FIG. 1. The transformer 1 is shown again in FIG. 5 with a current Is flowing in the 1 turn secondary winding 5, and a current Ip reflected into the primary winding 3. It can be seen that the net ampere-turns cannot be zero on both sides of the transformer if only these two windings 1 and 3 are present. However, a current Ic will flow in the flux distributing 7 winding to compensate. Using network analysis, the various currents can be calculated, and it can be seen that the compensating current Ic in the flux distributing winding 7 is reasonably small.

First, the primary current Ip is calculated as 8/45 of the secondary current Is, or 8IS/45. (8/45 is the reciprocal if 5⅝). In the left window of the transformer core 9, the net ampere-turns is equal to Is+5 Ip+5 Ic=0. In the right hand window of the transformer core 9, the net ampere-turns is equal to Is+6 Ip+3 Ic =0. Eliminating Is and solving for Ic, Ic=Ip/2. Substituting, Ic=4Is/45, or ½ of Ip.

Figure 6:
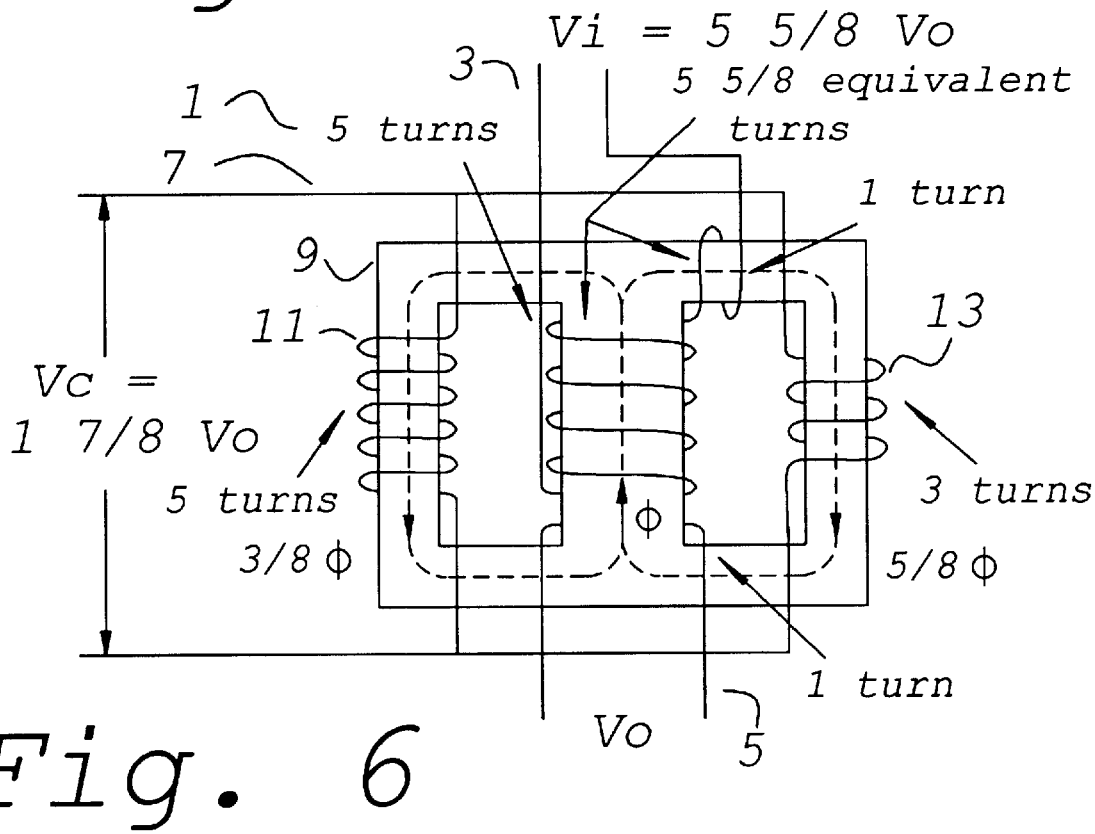
FIG. 6 shows the voltages on the windings, to support an analysis.

FIG. 6 shows the relative voltages in the transformer of FIG. 1. The flux distributing winding 7 has a unique and readily determined voltage relative to the other windings. (It can be used as an input or output winding if desired.) As explained above, the left-hand leg of the transformer core 9 has ⅜ the flux of the center leg. Vo is the voltage induced by the total flux in one turn, so ⅜ of the flux will induce 3Vo/8 per turn. There being 5 turns in winding 11, the voltage will be 15Vo/8, or 1⅞ Vo.

Figure 7:
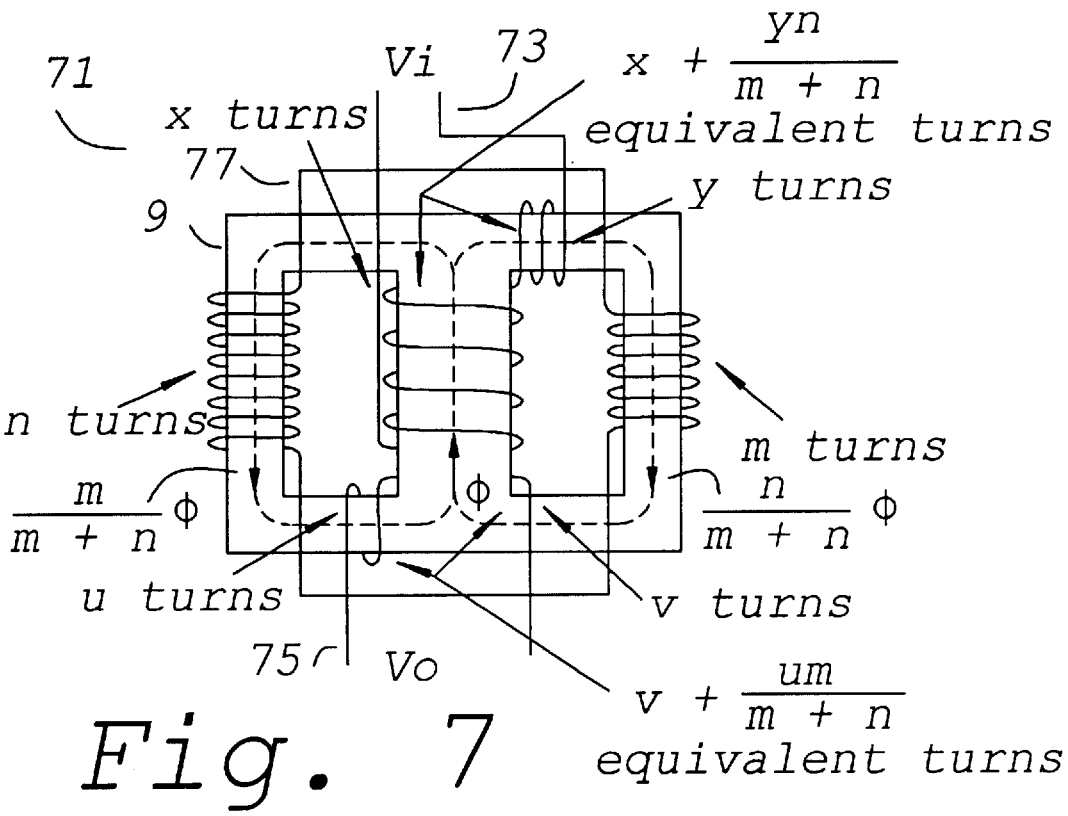
FIG. 7 shows the transformers with generalized algebraic notation for the winding design parameters.

FIG. 7 shows the relationship between the voltages in a transformer 71 expressed in algebraic notation for arbitrary turns. There are eight variables that can be manipulated (six are shown), so it is apparent that just about any desired ratio could be achieved. As shown, a primary winding 73 makes x turns around the center leg of the transformer core 9 and y turns around the right leg of the transformer core 9. As shown, a secondary winding 75 makes v turns around the center leg of the transformer core 9 and u turns around the left hand leg of the transformer core 9. A flux distributing winding 77 comprises n turns around the left hand leg of the transformer core 9 and m turns around the right had leg of the transformer core 9. The primary and secondary equivalent turns are as shown in FIG. 7, and the transformer equivalent turns ratio is the ratio of the primary equivalent turns to the secondary equivalent turns.

The generalized equation can be expanded further. The primary winding 73 could also have made z turns around the left-hand leg of the transformer core 9, adding a factor of zm/(m+n) to its equivalent turns expression. Similarly, the secondary winding 75 could also have made w turns around the right hand leg of the transformer core 9, adding a factor of wn/(m+n) to its equivalent turns expression. Note, too, that turns can be added to either winding with the opposite phasing, and the respective terms would have the same form, but would be negative.

Figure 8:
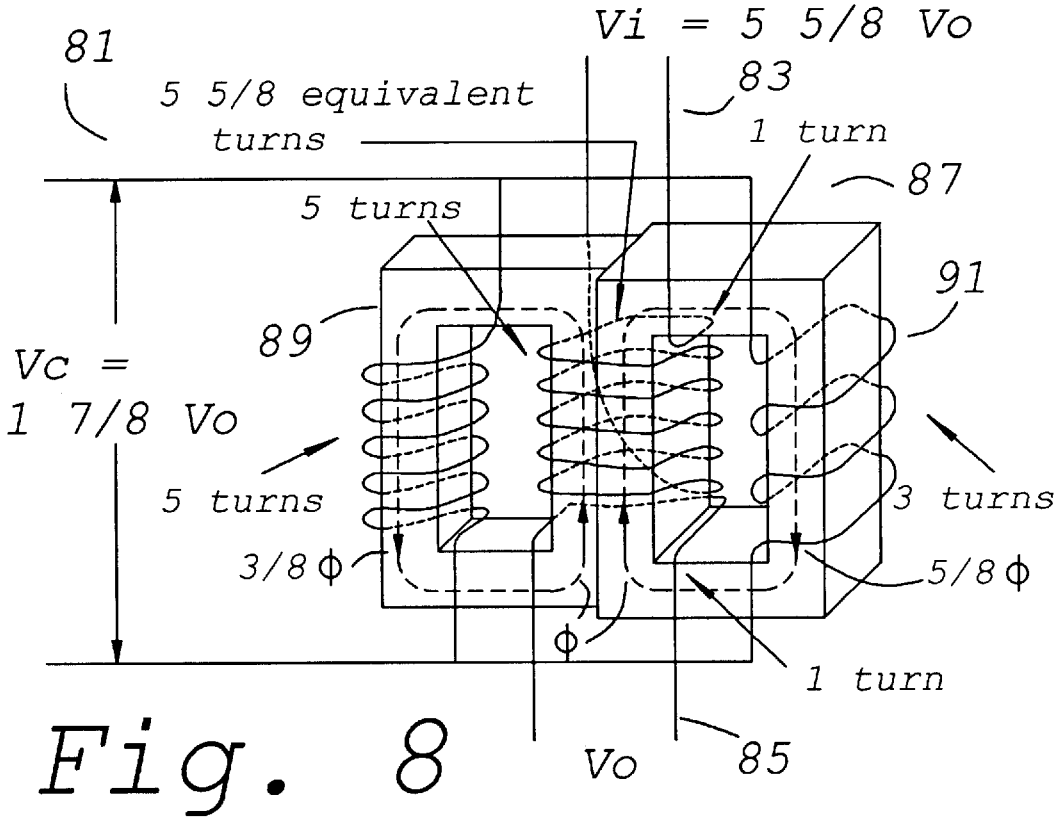
FIG. 8 shows magnetic cores of different height, and thus area, for equal flux density.

In the transformer 1 of FIG. 1, because the flux is different in the outer legs of the transformer core 9 when the flux distribution winding 1 is present, if the areas of the legs of the transformer are the same, then the flux density will be different in the several parts of the transformer 81. FIG. 8 shows that the area of the sides of a transformer 81 may differ to make the flux density more equal. It can also be seen that the magnetic core may comprise two separate cores 89 and 91 side by side and wired as one. FIG. 8 also shows that the flux distributing winding 87 may be used as an output. As shown, its voltage Vc is 1⅞ Vo, where Vo is the output voltage of a single turn secondary winding 85. A primary winding 83 has five turns around the left core 89 and six turns around the right core 91, giving an equivalent turns of 5⅝ turns.

Figure 9:
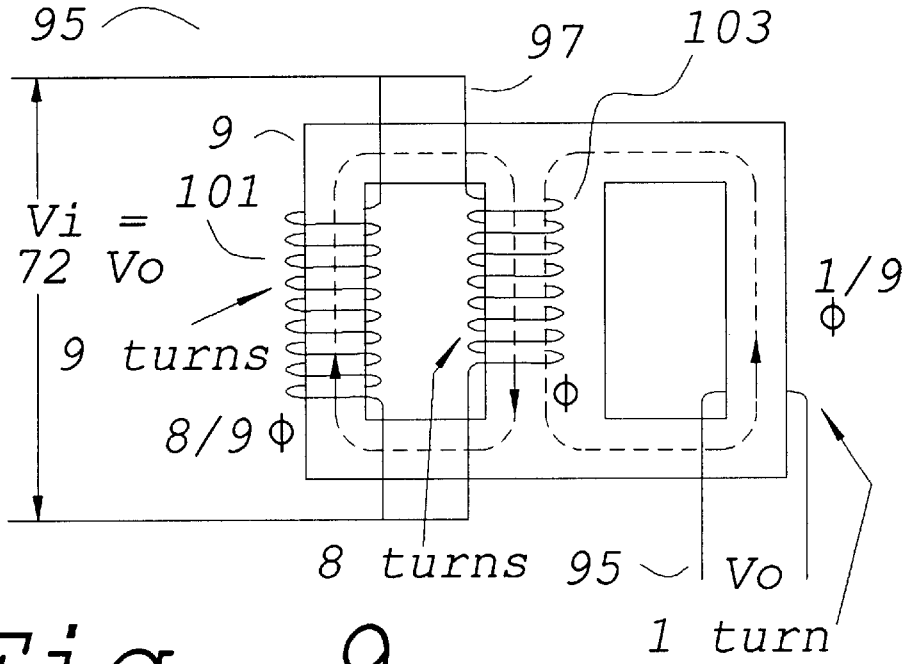
FIG. 9 shows a transformer having a difference mode flux distribution winding, to achieve very high equivalent turns ratios.

FIG. 9 shows that a flux distributing winding 97 can be wired in opposition, and that very large equivalent turns ratios are possible with windings having a small number of turns. It further shows that one side of the flux distribution winding 97 can be on the main flux path, in this example, the center leg of the magnetic core 9. In this example, a transformer 95 has a flux flowing in the right leg of the transformer core 9 that is not the sum of the fluxes in the other legs of the transformer core 9 as in the previous examples, but rather it is the difference. As shown the left-hand leg has a higher number of turns, so it will have a lower flux. In FIG. 9, the flux through the left hand winding 101 is ⅘ the flux through the center winding 103. This forces a small difference flux to flow in right-had leg of the transformer core 9, but it is a precisely determinable flux (neglecting leakage). In the is transformer 95 of FIG. 9, it will be 1⅘, or ⅕ of the flux through the center winding 103. A small flux will induce a small voltage in each turn of the output winding 95, in this example, ⅕ of the voltage per turn of the center winding 103. It can therefore be said to be the equivalent of ⅕ turn as compared to the winding 103 on the center leg of the transformer core 9. The over all ratio of this transformer 95 is 72 to 1, using the flux distribution winding 97 as the input. Since transformers are reciprocal, this transformer could also be used for large step up ratios.

Through out this specification and in the claims, "input", "output", "primary" and "secondary" are used arbitrarily to identify windings as examples, not limitations. It is understood that any winding can be the input or primary winding and all others can be outputs or secondary windings.

Figure 10:
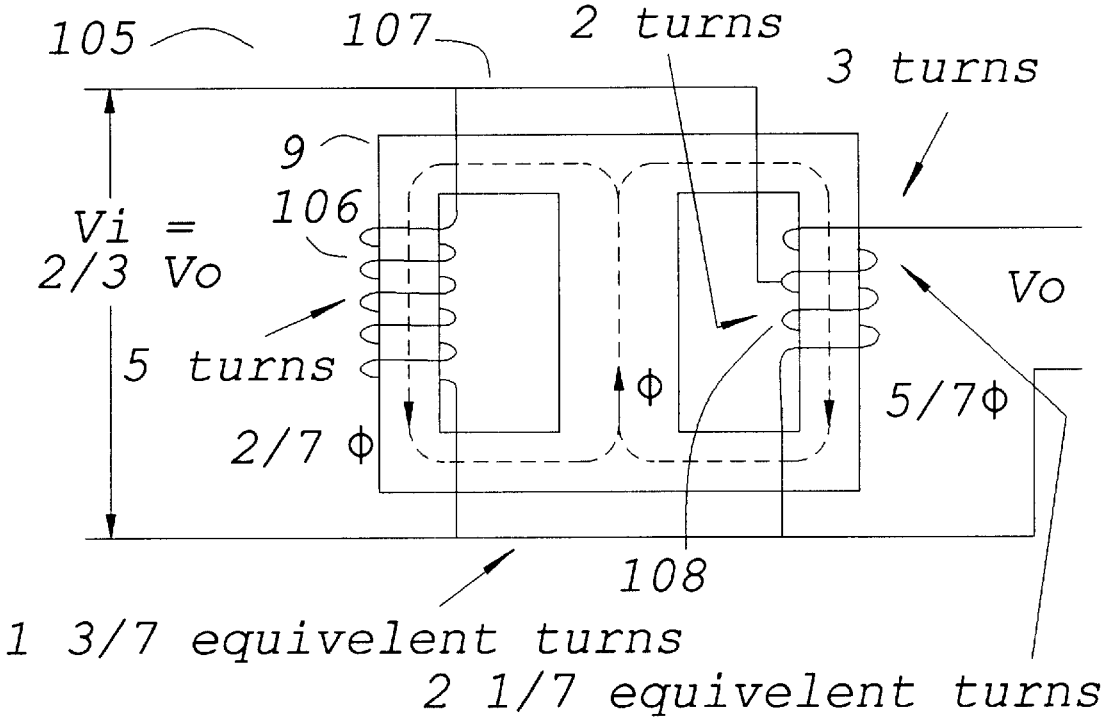
FIG. 10 shows that the flux distribution winding can be the input (primary) winding and output winding, and that it can be an auto-transformer winding.

FIG. 10 shows an auto transformer 105 in which the flux distributing winding 107 can be the input (primary) winding as well as the output winding (secondary). A first coil 106 of the flux distribution winding 107 is wound on the left-hand leg of a transformer core 9. A second coil 108 of the flux distribution coil 107 is wound on the right-hand leg of the magnetic core 9. The second coil 108 of the flux distribution winding 107 is wound so that the transformer 105 is an auto-transformer, and the input to the second coil of the flux distribution winding 107 is tapped into the second turn. The output Vo is from a third turn, so that with respect to the output, the second coil 108 of the flux distribution winding 107 has 2⅟₇ equivalent turns where as with respect to the input Vi, the flux distribution winding 107 has 1⅗ equivalent turns. Thus the overall equivalent turns ratio of the auto-transformer 105 is 2 to 3, a step up. While there may be easier ways to accomplish a two to three step up transformer, this FIG. 10 shows a number of various embodiments of the windings. Note that there is no winding on the center leg of the magnetic core 9, but it nonetheless is the main flux path since it carries the sum of the other two paths, and a turn thereon would have an equivalent turn of one turn.

Figure 11:
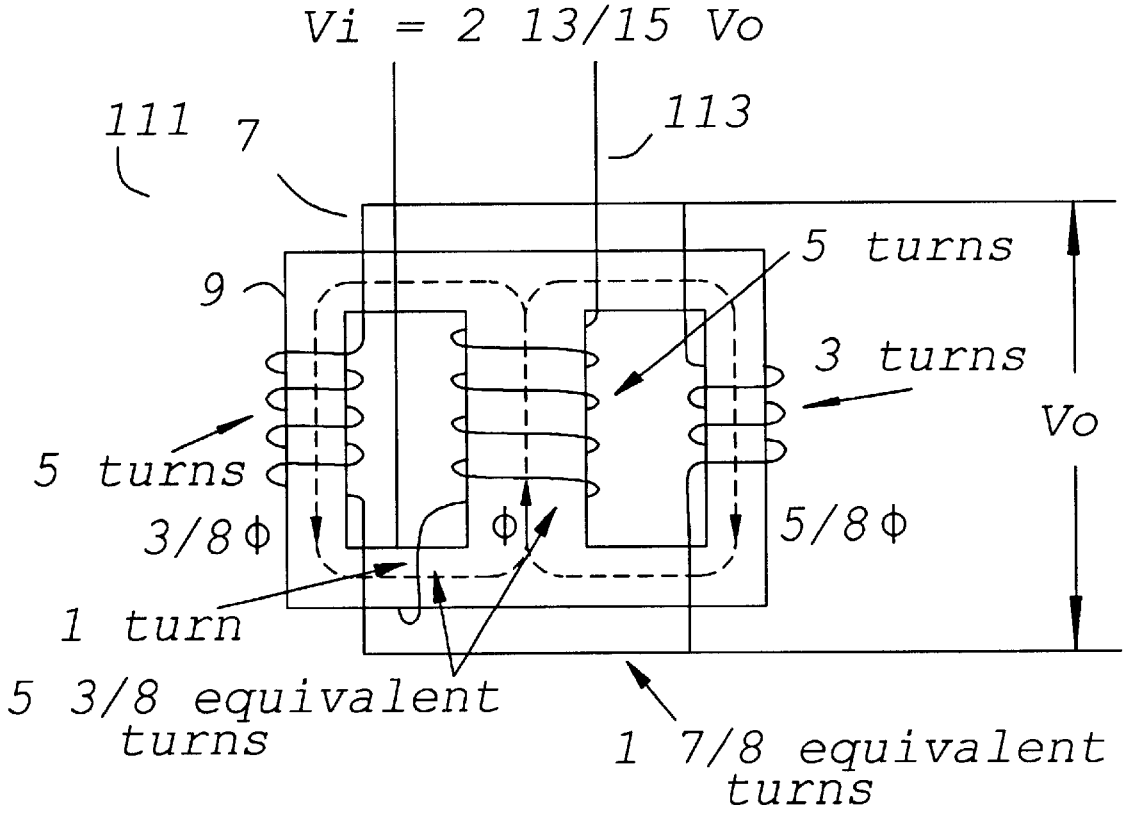
FIG. 11 shows that the flux distribution winding can be an output (secondary) winding.

FIG. 11 shows a transformer 111 in which the flux distribution winding 7 can be the secondary winding, and can be used as the output power source. A primary winding 113 makes five turns around the center leg of the transformer core 9, plus one additional turn around the left hand leg of the transformer core 9, for an equivalent turns of 5⅜ turns, giving an overall transformer ratio of 43 to 15.

Figure 12:
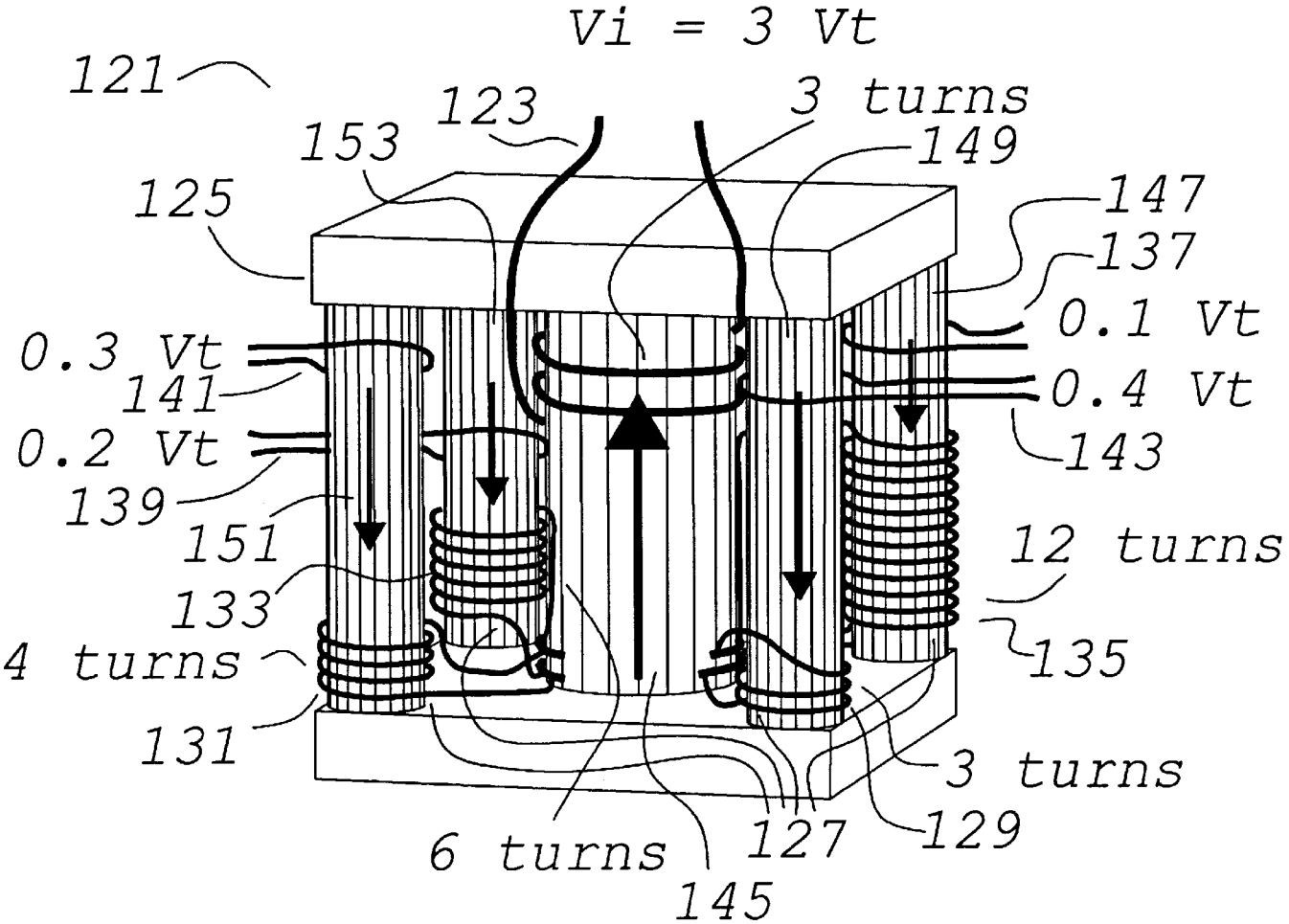
FIG. 12 shows another embodiment of the transformer having four parallel flux paths with flux distribution windings thereon so as to give equivalent turn increments of 0.1 turn.

FIG. 12 shows that the flux distribution teachings of this invention can be extended to additional parallel flux paths, in this example, four. The transformer 121 is wound on a transformer core 125 having a center leg 145 comprising a "main" flux path, and four parallel return legs 147, 149, 151 and 153 comprising first, second, third and fourth return flux paths. The flux distribution is chosen to be 0.1, 0.2, 0.3 and 0.4, and as it must be, their total is 1. This is accomplished by choosing the windings 129, 131, 133 and 135 of a flux distribution winding 127 such that the reciprocals of their respective turns is ¼, ½ and ¾ to 1. That is, if a first flux distribution winding has x turns, the remainder will have 4x/3, 2x and 4x turns respectively. In the present example of the transformer 121, a first flux distribution winding 129 has 3 turns, a second flux distribution winding 131 has 4 turns, a third flux distribution winding 133 has 6 turns, and a fourth flux distribution winding 135 has 12 turns, yielding, respectively, a flux distribution of 0.4, 0.3, 0.2 and 0.1 times the flux in the center leg 145 if all of the respective windings are connected together, in phase. In this arrangement, a winding taken around one or more of the return flux paths can have any fractional equivalent turn increment in 0.1 turn increments.

To provide a reference, a primary winding 123 is shown having 3 turns, thus the input voltage Vi equals 3 Vt, where Vt is the volts per turn in the center leg 145 of the transformer core 125. Since the fluxes in the return paths 147, 149, 151 and 153 of the transformer core 125 are constrained by the flux distribution winding 127, so too are the volts per turn in the output windings 137, 139, 141 and 143 to be, respectively, 0.1 Vt, 0.2 Vt, 0.3 Vt and 0.4 Vt.

Any input or output winding of the transformer 121 can make turns around the center leg 145 and/or around one or more of the return legs 147, 149, 151 and/or 153. With same phasing, the equivalent turns of the winding can be incremented in 0.1 turn increments. With reverse phasing, the equivalent turns can be decremented in 0.1 turn decrements.

Figure 13:
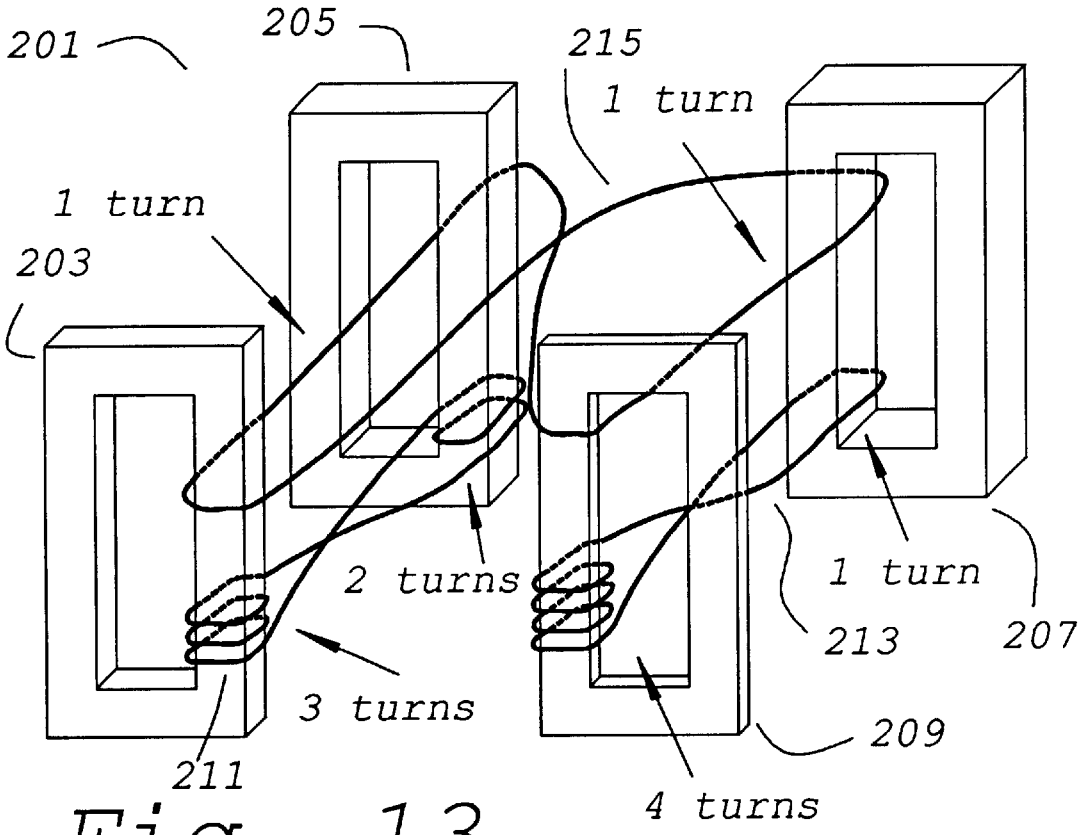
FIGS. 13 and 14 show a transformer comprising four cores.

FIG. 13 and show another embodiment of this invention. FIG. 13 shows a transformer 201 comprising four magnetic cores shown widely separated, for clarity, with a number of flux distributing windings in place. All have the same plane dimensions (magnetic path length, window dimensions and window area), but the cross sectional area varies because the "height" is different. On the right, the forward core 209 has ¼ the height of the rear core 207, and thus ¼ the cross sectional area. Also, a first flux distribution winding 213 couples the front core 209 to the rear core 207 and will force a flux distribution of 1 to 4. Thus, the flux density is the same in both of the cores 207 and 209.

On the left, the cores 203 and 205 have relative heights of 2 to 3, and a 2 and 3 turn flux distribution winding 211 to force a 3 to 2 flux distribution with the same flux density in each. Finally, another flux distribution winding 215 couples the right side set to the left side set. This flux distribution winding has equal turns, so the total flux in each side is equal. In this way, the flux is distributed 0.1, 0.2, 0.3 ad 0.4. The combined height of each side is equal.

If there is some reason to do so, the winding 209 could have any multiplier x to each coil, the winding 211 could have any multiplier y to each coil and the winding 215 could have any multiplier z to each coil. A reason to use a higher number of turns might be to reduce the currents proportionally therein. Also, coils with a large number of small wires may lay better and interconnect more easily than if a smaller number of large wires were used.

Figure 14:
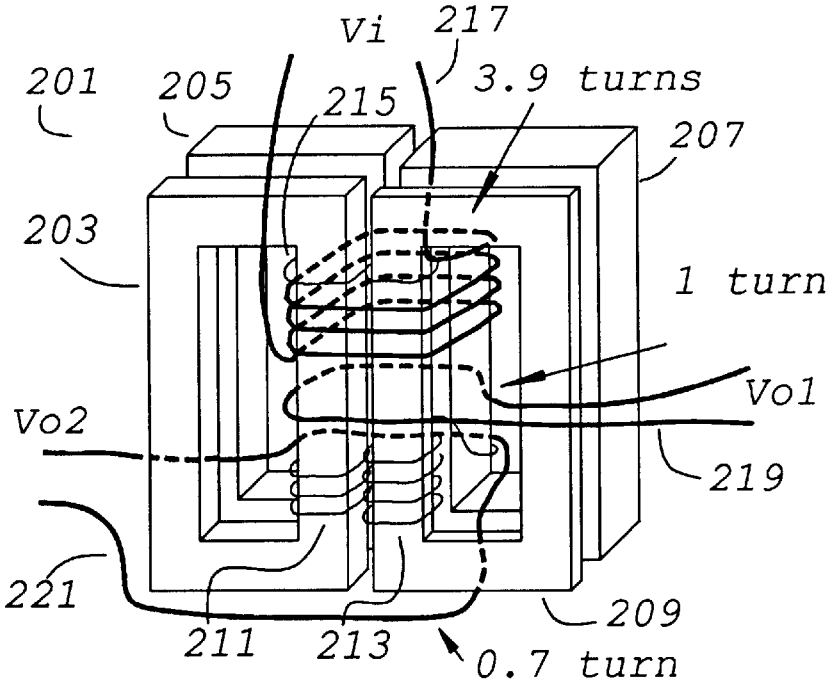

FIG. 14 shows the same transformer 201 of FIG. 13 with the cores 203, 205, 207 and 209 closer together. In a practical transformer, they cores should be as close together as possible, though some space between them is necessary and desirable, to provide room for the flux distribution windings and to keep the flux from leaking appreciably between cores. The combined flux path of the four cores defines the "main" flux path, with first, second, third and fourth return flux paths around the outside. Since the cores do not actually join in the center, the flux distribution coils can be located in the center on their respective cores. In the specification and the claims, a claim that a coil is on a return flux path includes this arrangement, it being equivalent.

In a manufactured transformer, all of the flux distribution windings can be in place and potted in the center, and the core could be very similar in appearance to an ordinary E-I or E-E transformer. With some space between the several core parts, primary and secondary windings 217, 219 and 221 may exit the transformer so as to couple some but not all of the side legs to effect turns with available increments of 0.1 turn, from 0.1 turn to as large a winding as desired, N+m/10, where N and m are integers.

In a practical transformer, there may be a main secondary winding with high current. It is preferred that this winding have a whole number of turns, and often that whole number will be 1 as illustrated by the first output winding 219. Although shown as a single winding as an illustration, not a limitation, it may be a push pull winding or a split winding. The primary winding 217 can then have fractional extra turns to give a closer to ideal equivalent turns ratio. In the example of the transformer 201, the primary winding 217 can be seen to make three full turns around the center of the transformer 201 plus an additional partial turn coupling cores 203, 205 and 207, exiting through the top between cores 207 and 209 without passing through core 209. This is equivalent to an extra 0.9 turns, for a total of 3.9 equivalent turns.

Additional secondary windings can have fractional turns or fractional extra turns. As an example, the second secondary winding 221 passes around center through cores 205 and 207 only. Passing once through core 205 gives an equivalent turn of 0.3, and passing once through core 207 gives an equivalent turn 0.4, for a total of 0.7 equivalent turn.

It is envisioned that the transformer of FIG. 14 may be fabricated as an E core with the flux distribution windings potted onto the center leg. Gaps or openings can be left for any fractional turn windings, or a series of undedicated loops to be wired later could be pre-installed on each of the four legs. Windings with several taps could also be used, with the taps having 1/10th-turn or multiples of 1/10th-turn increments.

Throughout this specification and in the drawings the magnetic cores as shown as simple structures to keep the illustrations clear. As would be well understood by one skilled in the art of making transformers, there are a wide variety of magnetic cores available, such as E-E, E-I, C-I, U-I, C-C, U-U, L-L, toroids, pot cores of varied design and so forth. As long as the required windings can be put in place on the required parallel flux paths, a transformer using any magnetic core variety or structure is equivalent.

I claim:

1. A transformer having fractional equivalent turns on at least one winding, comprising at least a first magnetic core, the at least a first magnetic core comprising a magnetic circuit having at least three flux paths, a source of magnetomotive force to generate magnetic flux in the at least three flux paths, the source of magnetomotive force having a phase defined by the timing and the direction of the flux which it generates in the at least three flux paths, and a flux distribution winding to determine the distribution of the flux in the at least three flux paths comprising a first flux distribution coil wound around one of the at least three flux paths, and at least a second flux distribution coil wound around at least a second of the at least three flux paths, the at least a first flux distribution coil having a number n turns where n is a positive or negative integer, the sign of the number n indicating its phase with respect to the phase of the source of magnetomotive force, the at least a second flux distribution coil having a number m turns where m is a positive or negative integer, the sign of the number m indicating its phase with respect to the phase of the source of magnetomotive force, the first flux distribution coil and at least the at least a second flux distribution coil further being connected together so that the first flux distribution coil and at least the at least a second flux distribution coil have a common terminal voltage Vt induced in the first flux distribution coil and at least the at least a second flux distribution coil by the flux through the first flux distribution coil and the flux through at least the at least a second flux distribution coil, whereby through flux through the first flux distribution coil is proportional to Vt divided by n and whereby the flux through the at least a second flux distribution coil is proportional to Vt divided by m.

2. The transformer of claim 1 wherein a total number of flux paths comprising the at least three flux paths is a number x and a total number of flux distributing coils comprising the first flux distributing coil and the at least a second flux distributing coil is a number equal to x minus one.

3. The transformer of claim 1 wherein the input of the transformer is connected to the flux distribution winding.

4. The transformer of claim 1 wherein an output of the transformer is connected from the flux distribution winding.

5. The transformer of claim 1 wherein the first flux distribution coil and the at least a second flux distribution coil are connected with the same phase.

6. The transformer of claim 1 wherein the first flux distribution coil and the at least a second flux distribution coil are connected with opposite phase.

7. The transformer of claim 1 further comprising at least a first additional winding wound around at least one of the at least three flux paths.

8. The transformer of claim 7 wherein the at least additional winding is wound around one of the at least three flux paths.

9. The transformer of claim 7 wherein the at least one additional winding is wound first around a first flux path of the at least three flux paths with a number of turns equal a number u and then around at least a second flux path of the at least three flux paths with a number of turns equal the number v where u and v are negative or positive integers and where the sign of the integer indicates its phase with respect to the phase of the source of electromotive force whereby a voltage induced in the at least a first additional winding will be proportional to u times the flux through the first flux path plus v times the flux through the second flux path.

10. The transformer of claim 7 wherein the input to the transformer is connected to the at least one additional winding.

11. The transformer of claim 8 wherein an output from the transformer is connected to the at least one additional winding.

12. The transformer of claim 1 wherein at least one of the first flux distribution coil and the at least a second flux distribution coil is a tapped coil.

13. The transformer of claim 2 wherein the total number of flux paths is five, comprising a main flux path and first, second, third and fourth return flux paths, and wherein the total number of flux distribution coils is at least four, comprising at least first, second, third and fourth flux distribution coils.

14. The transformer of claim 13 wherein the first flux distribution coil is on the first return flux path, the second flux distribution coil is on the second return flux path, the third flux distribution coil is on the third return flux path and the fourth flux distribution coil is on the fourth return flux path.

15. The transformer of claim 14 wherein the respective first, second, third and fourth flux distribution coils have a ratio of three to four to six to twelve, whereby the magnitude of the flux in the respective first, second, third and fourth return flux paths will have a ratio with respect to each other of 4 to 3 to 2 to 1 and the magnitude of the flux in the respective first, second, third and fourth return flux paths is respectively 0.4, 0.3, 0.2 and 0.1 times the flux in the main flux path.

16. The transformer of claim 14 wherein the first flux distribution coil is connected to the second flux distribution coil and the third flux distribution coil is connected to the fourth flux distribution coil, and further comprising a fifth flux distribution coil wound around both of the first return flux path and the second return flux path and a sixth flux distribution coil wound around both the third return flux path and the fourth return flux path.

17. The transformer of claim 16 wherein the first flux distribution coil has one times x turn, the second flux distribution coil has four times x turns, the third flux distribution coil has two times y turns, the fourth flux distribution coil as three times y turns, the fifth flux distribution coil has one times z turns and the sixth flux distribution coil has one times z turns, where x, y and z are integers, whereby the magnitude of the flux in the respective first, second, third and fourth return flux paths is respectively 0.4, 0.1, 0.3 and 0.2 times the flux in the main flux path.

* * * * *